US012320226B2

(12) United States Patent
Moses et al.

(10) Patent No.: US 12,320,226 B2
(45) Date of Patent: Jun. 3, 2025

(54) MIXED ELEMENT SWELL PACKER SYSTEM AND METHOD

(71) Applicant: Schlumberger Technology Corporation, Sugar Land, TX (US)

(72) Inventors: Nicholas Moses, Kuala Lumpur (MY); Mark Wei Xiong Yun, Seria (BN); Joel Gil, Rosharon, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 17/810,394

(22) Filed: Jul. 1, 2022

(65) Prior Publication Data

US 2023/0003096 A1 Jan. 5, 2023

(30) Foreign Application Priority Data

Jul. 2, 2021 (MY) ..... MY2021003799

(51) Int. Cl.
*E21B 33/12* (2006.01)
*E21B 23/06* (2006.01)

(52) U.S. Cl.
CPC ..... *E21B 33/1208* (2013.01); *E21B 23/06* (2013.01)

(58) Field of Classification Search
CPC ..... E21B 33/1208; E21B 23/06
See application file for complete search history.

(56) References Cited

U.S. PATENT DOCUMENTS 11,261,693 B2 * 3/2022 Pelto ..... E21B 33/1208
2004/0118572 A1 * 6/2004 Whanger ..... E21B 33/12 166/207
2004/0261990 A1 * 12/2004 Bosma ..... E21B 43/103 166/50
2005/0110217 A1 * 5/2005 Wood ..... E21B 33/1208 277/333
2007/0012436 A1 * 1/2007 Freyer ..... E21B 33/12 166/65.1
2007/0044962 A1 * 3/2007 Tibbles ..... E21B 43/045 166/278
2007/0151724 A1 * 7/2007 Ohmer ..... E21B 47/01 166/187
2008/0185158 A1 * 8/2008 Chalker ..... E21B 33/13 166/387
2008/0296014 A1 * 12/2008 Richard ..... E21B 33/1208 285/381.2
2009/0139707 A1 * 6/2009 Berzin ..... E21B 33/1216 29/428

(Continued)

*Primary Examiner* — Steven A MacDonald
(74) *Attorney, Agent, or Firm* — Jeffrey D. Frantz

(57) ABSTRACT

A technique facilitates use of a swellable packer or packers which may be disposed along completion equipment of a well string. Each packer comprises a packer frame and a plurality of swellable elements formed of materials which swell in different types of fluids. The plurality of swellable elements may comprise a first swellable element mounted on the packer frame and swellable in a first type of fluid. A second swellable element also may be mounted on the packer frame proximate the first swellable element and swellable in a second type of fluid which is different from the first type of fluid. Additionally, a portion of an alternate path system may extend through the swellable elements to facilitate a gravel packing operation.

17 Claims, 3 Drawing Sheets

(56) References Cited

U.S. PATENT DOCUMENTS

| | | | | |
|---|---|---|---|---|
| 2009/0205842 | A1* | 8/2009 | Williamson | E21B 33/1208 166/387 |
| 2010/0096119 | A1* | 4/2010 | Sevre | E21B 33/1294 166/51 |
| 2010/0139930 | A1* | 6/2010 | Patel | E21B 33/1208 166/387 |
| 2010/0230902 | A1* | 9/2010 | Castillo | E21B 33/1208 277/331 |
| 2010/0300689 | A1* | 12/2010 | McRobb | E21B 33/1277 166/387 |
| 2012/0073830 | A1* | 3/2012 | Lembcke | E21B 33/1208 166/134 |
| 2014/0102724 | A1* | 4/2014 | Hales | E21B 33/1208 166/386 |
| 2015/0260006 | A1* | 9/2015 | Andersen | E21B 33/1208 29/428 |
| 2016/0017686 | A1* | 1/2016 | Ferg | E21B 33/1208 166/290 |
| 2021/0017835 | A1* | 1/2021 | Pelto | E21B 33/1208 |
| 2021/0332659 | A1* | 10/2021 | Fripp | E21B 33/1208 |

* cited by examiner

MIXED ELEMENT SWELL PACKER SYSTEM AND METHOD

CROSS-REFERENCE TO RELATED APPLICATION

The present application claims priority benefit of MY Application No. PI2021003799, filed Jul. 2, 2021, the entirety of which is incorporated by reference herein and should be considered part of this specification.

BACKGROUND

In many oil and gas well applications, a wellbore is drilled into the earth and through a reservoir of the desired fluid, e.g. oil and/or gas. The wellbore may subsequently be completed with appropriate completion equipment comprising screens, packers, and other equipment selected to facilitate production of the desired fluids from the reservoir. In some applications, the completion equipment may comprise alternate path systems which facilitate gravel packing of the annulus between the completion equipment and the surrounding wellbore wall. The gravel packing is used to establish a gravel pack sufficient to filter out particulates from the well fluid as it flows from the reservoir, into the wellbore, and into the completion equipment for production to a desired collection location. Installation of the gravel pack may occur along a number of well zones which are isolated via packers positioned along the completion equipment at a desired spacing. At an appropriate time, the packers are actuated to form a seal with the surrounding wellbore wall, thus isolating the desired well zones along the wellbore.

SUMMARY

In general, a system and methodology facilitate improved actuation and use of packers disposed along completion equipment by utilizing mixed swelling elements. According to an embodiment, a packer or packers may be disposed along the completion equipment of a well string to provide seals along a borehole at desired locations. Each packer comprises a packer frame and a plurality of swellable elements formed of materials which swell in different types of fluids. For example, the plurality of swellable elements may comprise a first swellable element mounted on the packer frame and swellable in a first type of fluid. Additionally, a second swellable element is mounted on the packer frame proximate the first swellable element and swellable in a second type of fluid which is different from the first type of fluid, e.g. oil versus water. A portion of an alternate path system may extend through the swellable elements to facilitate a gravel packing operation.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
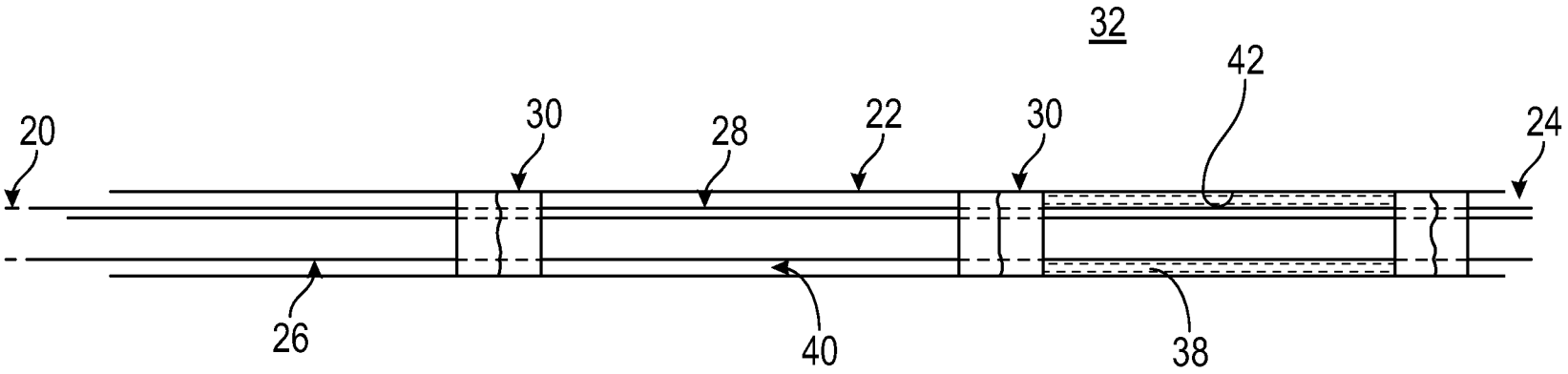
FIG. 1 is an illustration of an example of a well string comprising completion equipment having a plurality of mixed element swellable packers, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology which facilitate improved actuation and use of packers. According to an embodiment, a packer or packers may be disposed along completion equipment of a well string to provide seals along a borehole, e.g. a wellbore, at desired locations. The packers are constructed as swellable packers which have a mixed element swellable section to enable the desired swelling and sealing when exposed to different types of fluids.

For example, each packer may comprise a packer frame and a plurality of swellable elements formed of materials which swell in different types of fluids. The plurality of swellable elements may comprise two swellable elements or a greater number of swellable elements. By way of example, the mixed swellable elements may comprise a first swellable element mounted on the packer frame and swellable in a first type of fluid. In this example, a second swellable element also may be mounted on the packer frame at a position proximate the first swellable element and swellable in a second type of fluid which is different from the first type of fluid. For example, the first swellable element may swell in the presence of water while the second swellable element swells in the presence of oil. However, the swellable elements may be selected to undergo the desired swelling and sealing along the wellbore when exposed to other types of fluids. Additionally, a portion of an alternate path system may extend through the swellable elements to facilitate a gravel packing operation.

The individual packers may be constructed in a variety of sizes and configurations depending on the parameters of a given application. By way of example, the swellable elements may be placed adjacent to each other to form the desired mixed element structure and then molded and bonded over shunt tubes of an alternate path system. The mixed element structure provides a user flexibility with respect to use of a variety of fluids, e.g. hydrocarbon or water-based fluids, to achieve the desired swelling in a single shunted packer. Swelling of a single element when reacting with the corresponding fluid is sufficient to swell the packer to the maximum outside diameter so as to form sufficient contact and sealing against the surrounding borehole wall, thus providing the desired mechanical integrity and pressure barrier along the borehole, e.g. wellbore. Depending on the application, the packer may be used to form a seal against casing, against an open hole wall, or against another type of surrounding borehole wall.

The sequence and arrangement of the swellable elements, e.g. two or more swellable elements, may vary and can be selected according to the type of well and the type of naturally occurring or pumped down fluids available in a given operation. In some operations, naturally occurring fluids may be used to provide the desired swelling of the swellable element or elements. In other operations, however, selected fluids may be circulated downhole and into contact with the swellable elements to achieve the desired swelling of at least one of the swellable elements. Additionally, the swellable elements may be formed from suitable elastomers or other swellable materials. The swellable elements may be solid and continuous body type elements; solid and continuous incised body type elements; incised or segmented body type elements; or other suitable constructions.

When fully swelled, the outside diameter of an individual swellable element is able to act as a mechanical barrier for diverting fluid and gravel pack slurry through, for example, shunt tubes. The individual swelled element also can serve as a pressure barrier to provide zonal isolation between adjacent well zones along the wellbore to prevent unwanted communication and co-mingling of fluids between zones. In some applications, gravel packing may be performed through alternate path systems, e.g. through shunt tubes, after swelling of the desired swellable packers. In other applications, however, the gravel packing operation may be performed first while leaving the desired swellable packers to swell to their target outside diameters once exposed to certain fluids following the gravel packing operation.

Referring generally to FIG. 1, an example of a well string 20 is illustrated as deployed in a borehole 22, e.g. a wellbore. In this example, the well string 20 comprises a completion system 24 disposed downhole in borehole 22 for use in gravel packing operations, production operations, and/or other well related operations. The completion system 24 may comprise a variety of downhole components, including production tubing 26, an alternate path system 28 deployed along the production tubing 26, and a plurality of swellable packers 30 spaced along the production tubing 26. It should be noted the completion system 24 may comprise a wide variety of additional or other components to facilitate the desired downhole operations. For example, the completion system 24 may comprise screens, filters, inflow control devices, shrouds, sensors, and various other types of components. Many of these components are selected and arranged to facilitate production of a desired well fluid, e.g. oil and/or gas, from a surrounding formation 32.

Figure 2:
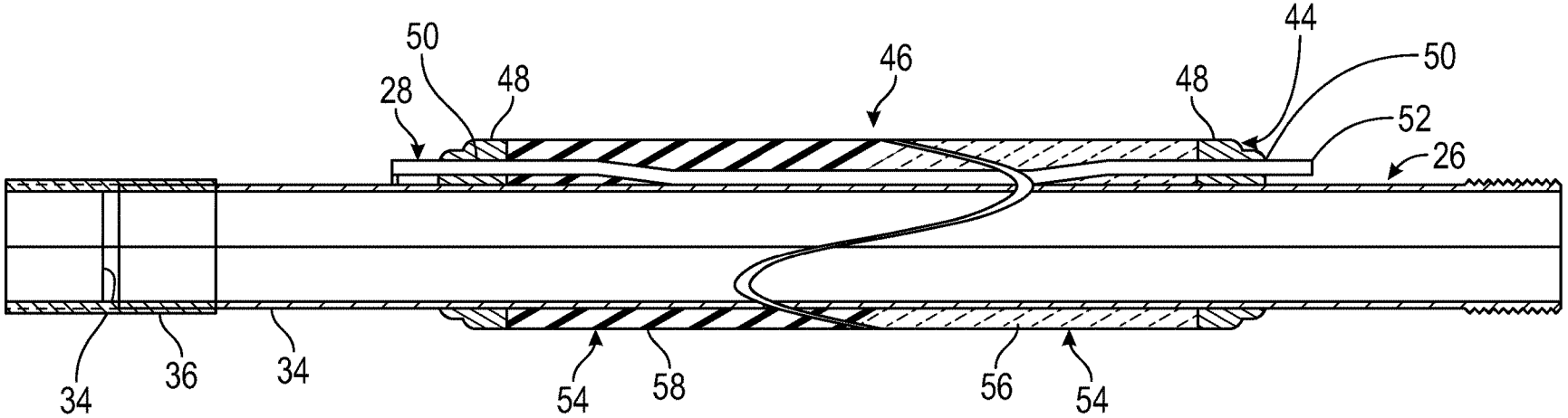
FIG. 2 is a cross-sectional illustration of an example of a mixed element swellable packer positioned along a completion system, according to an embodiment of the disclosure.
Figure 3:
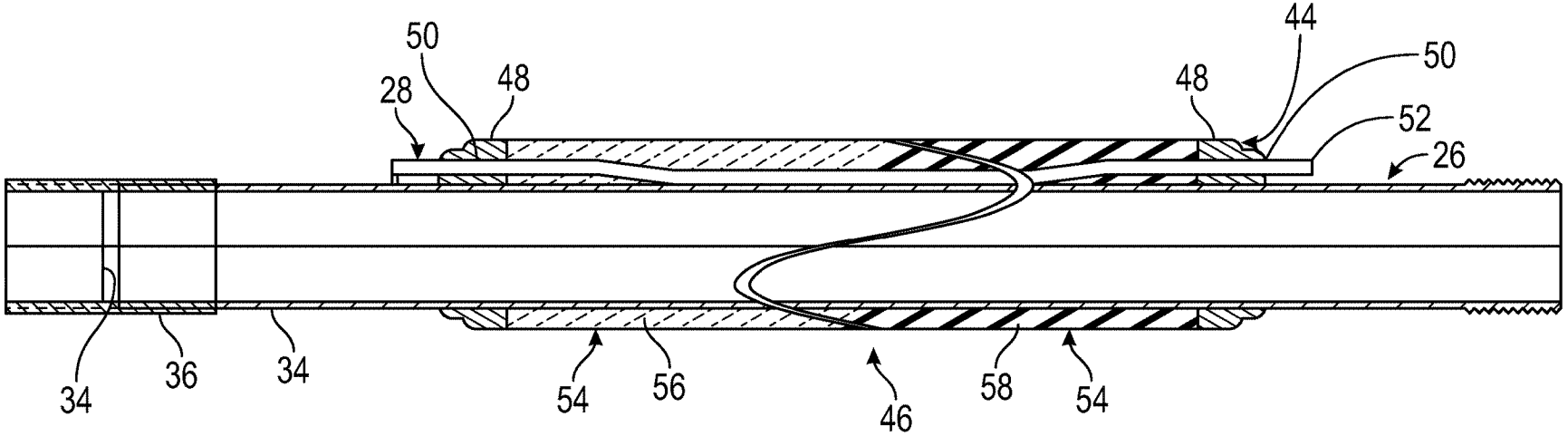
FIG. 3 is a cross-sectional illustration of another example of a mixed element swellable packer positioned along a completion system, according to an embodiment of the disclosure.

The production tubing 26 may be formed from a plurality of base pipe joints 34 connected by suitable couplers 36 (see FIGS. 2 and 3). The alternate path system 28 may be routed along the production tubing 26 and through the swellable packers 30 so as to ensure uniform gravel packing in the well zones disposed along the wellbore 22. As illustrated, various gravel packing techniques may be used to establish a gravel pack 38 disposed in an annulus 40 between the completion system 24 and a surrounding wall 42 forming wellbore 22. Depending on the well application, the surrounding wall 42 may be, for example, the interior of well casing or the open wellbore wall formed during drilling of the wellbore.

In FIG. 1, the swellable packers 30 are illustrated as swelled to their enlarged, target outside diameter. In this swelled state, each swellable packer 30 establishes a firm, sealing engagement with the surrounding wellbore wall 42 so as to create a desired mechanical and/or pressure barrier between well zones/regions along the wellbore 22, e.g. along annulus 40. As described in greater detail below, the swellable packers 30 may comprise mixed elements which individually expand in the presence of a predetermined fluid to provide the desired engagement with the surrounding wellbore wall 42. In the embodiment of FIG. 1, three swellable packers 30 are illustrated however the completion system 24 may comprise various numbers of swellable packers 30, including a single swellable packer 30, two swellable packers 30, or three or more swellable packers 30.

Referring generally to FIG. 2, an example of one of the swellable packers 30 is illustrated. In this example, the swellable packer 30 comprises a packer frame 44 disposed about the production tubing 26. The packer frame 44 may have a variety of configurations for supporting a mixed swellable element system 46. According to the embodiment illustrated, the packer frame 44 comprises end rings 48 having openings 50 to receive the alternate path system 28 therethrough. For example, the alternate path system 28 may comprise shunt tubes 52 for carrying gravel slurry to desired gravel packing regions along the wellbore 22. The shunt tube or tubes 52 may be routed through the openings 50 of end rings 48 along the exterior of production tubing 26.

By way of example, the mixed swellable element system 46 may comprise a plurality of swellable elements 54 which are located longitudinally between the end rings 48 and over the shunt tubes 52. In some embodiments, the swellable elements 54 are swellable elastomeric elements which may be wrapped around the shunt tubes 52 and the production tubing 26 and then cured and bonded in place. However, a variety of mounting techniques may be used for mounting the swellable elements 54 at the desired position relative to packer frame 44. The swellable elements 54 are unique elements that may be positioned proximate to each other, e.g. contiguous with each other between the end rings 48.

The specific material of individual swellable elements 54 is selected to uniquely respond based on its exposure to a specific fluid or fluids. The combination of different individual swellable elements 54 in a single packer 30 enables swelling in response to exposure to different fluids. For example, an individual swellable element (or elements) 54 may swell in the presence of water while another individual swellable element (or elements) 54 of the same swellable packer 30 swells in the presence of a different fluid such as oil.

It should be noted that swelling in the presence of water is intended to mean swelling in the presence of water-based fluids and such fluids may include constituents other than simply water. For example, the water may include salts, acids, minerals, other treatment chemicals, or other constituents that do not prevent water induced swelling of the corresponding swellable element(s) 54. Similarly, swelling in the presence of oil is intended to mean swelling in the presence of oil-based fluids and such fluids may include constituents other than simply oil. For example, the oil may include gases and other constituents that do not prevent oil induced swelling of the corresponding swellable element(s) 54.

The number of swellable elements 54 in a given packer 30 may vary. For purposes of explanation, the packer 30 illustrated in FIG. 2 comprises two swellable elements 54 positioned adjacent each other between end rings 48 of packer frame 44. The two swellable elements 54 comprise a first swellable element 56 which swells in the presence of a first fluid, e.g. water, and a second swellable element 58 which swells in the presence of a second fluid, e.g. oil. Accordingly, the second swellable element 58 swells in the presence of a different type of fluid than the fluid which causes swelling of the first swellable element 56.

However, the swelling of either of the swellable elements 56, 58 is sufficient to create a seal with the surrounding wellbore wall 42 which has the desired mechanical and pressure integrity. As a result, each swellable packer 30 ensures creation of the desired barrier in the presence of different types of fluids and thus enhances the reliability of completion system 24 during a given operation.

In the example illustrated, the unique fluids are in the form of water and oil for causing swelling of swellable elements 56, 58, respectively. However, the materials used to form the different swellable elements 56, 58 may be selected to respond to a variety of different types of fluid. In some embodiments, individual swellable elements 54 may be selected to swell in response to various treatment chemicals pumped downhole to facilitate, for example, a gravel packing operation and/or production operation.

Many types of materials are swellable in the presence of water and may be used to form swellable element 56 in at least some downhole applications. Examples of such materials include elastomeric materials such as tetrafluoroethylene/propylene copolymer (TFE/P), vinyl acetate/acrylate copolymer, carboxymethylcellulose type polymer, isobutylene/maleic anhydride copolymer, and a variety of other elastomeric materials which may be selected according to the parameters of a given well application. Other examples may include various composite materials or non-elastomeric materials such as swelling clay material.

Similarly, there are many types of materials which are swellable in the presence of oil and may be used to form swellable element 58 in at least some downhole applications. Examples of such materials include chlorinated butyl rubber, polyurethane rubber, butyl rubber, various silicone rubbers, and a variety of other oil-swellable rubbers, sulfonated polyethylene, ethylene/propylene/diene terpolymer, and a variety of other materials. Additionally, various combinations of these materials and other composite and/or non-elastomeric materials may sufficiently swell in the presence of oil and have sufficient sealing and structural characteristics to form swellable element 58. Various materials which swell when placed in contact with other types of fluids also may be used in the construction of swellable element 56 and/or swellable element 58.

As illustrated in FIG. 3, the arrangement of first and second swellable elements 56, 58 may be reversed or otherwise changed. Some embodiments may utilize additional materials which respond to additional types of unique fluids. Furthermore, some embodiments may utilize greater numbers of the swellable elements 54 to ensure the desired contact and sealing with the surrounding wall 42. In the examples illustrated in FIGS. 2 and 3, each swellable element 56, 58 has sufficient length to establish the desired seal with the desired mechanical and pressure integrity along annulus 40. In some environments, the longitudinal length of each swellable element 56, 58 may be 5 feet or more.

Figure 4:
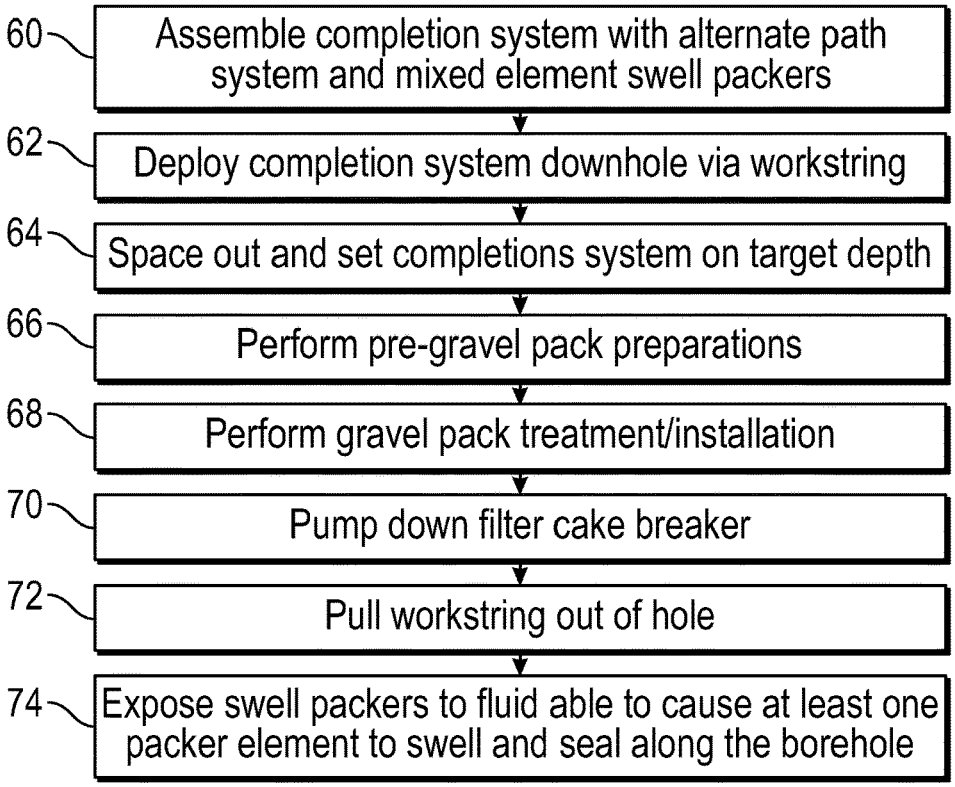
FIG. 4 is a flowchart illustrating an operational example for utilizing mixed element swellable packers along a wellbore, according to an embodiment of the disclosure.

Referring generally to FIG. 4, an operational example is illustrated via a flow chart. In this example, the well application involves use of alternate path system 28 to establish a gravel pack along completion system 24 deployed in wellbore 22. Initially, the number of zones or sections of the wellbore 22 and the fluid types that will be encountered or utilized in the operation may be determined. This enables selection of the number of swell packers 30 and the types of swell elements 54 to be utilized. Because each swell packer 30 employs a mixture of the swell elements 54, the successful swelling/expansion of the swell packers 30 can be assured even when there is less specific knowledge with respect to the fluids that will be entering wellbore 22.

As illustrated, the completion system 24 is initially assembled with the desired components which may include a variety of bottom hole assemblies, alternate path system 28, and the desired number of swellable packers 30, as indicated by block 60. The packers 30 are constructed with the appropriate swellable elements 54 and internal shunt tubes 52. The completion system 24 is then deployed downhole into wellbore 22 via a workstring, as indicated by block 62. Subsequently, a suitable space out procedure may be implemented to help set the completion system 24 at a target depth in the wellbore 22, as indicated by block 64.

Once the completion system 24 is properly positioned, pre-gravel pack preparations may be performed, as indicated by block 66. This allows the gravel pack treatment/installation to be performed to establish the desired gravel pack 38, as indicated by block 68. In some applications, an optional filter cake breaker may be pumped downhole to remove filter cake, as indicated by block 70. At this stage, the workstring may be released and pulled out of hole, as indicated by block 72. The completion system 24 with the shunted swellable packers 30 remains downhole to allow exposure of the swellable elements 54 to fluids which will cause one or more of the swellable elements 54 to swell and expand into sealing contact with the surrounding wellbore wall 42, as indicated by block 74. Because individual swellable elements 54 uniquely respond to different fluids, e.g. oil or water, at least one of the swellable elements 54 is assured of expanding into the desired sealing contact.

Figure 5:
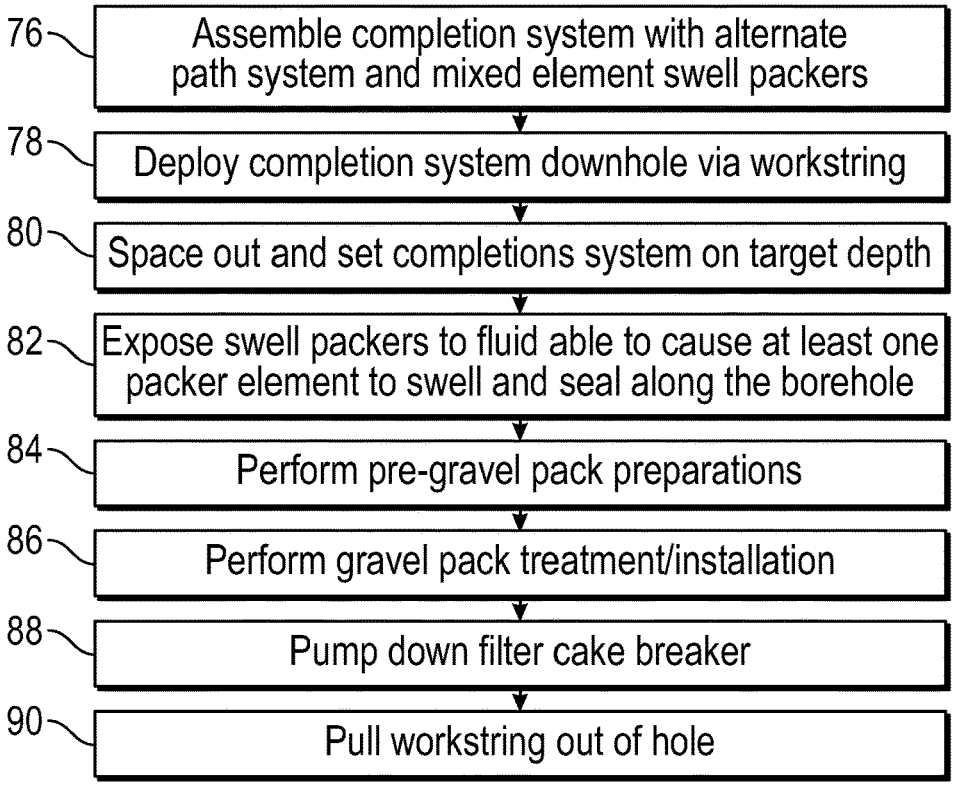
FIG. 5 is a flowchart illustrating another operational example for utilizing mixed element swellable packers along a wellbore, according to an embodiment of the disclosure.

Referring generally to FIG. 5, another operational example is illustrated via a flow chart. In this example, the well application again involves use of alternate path system 28 to establish a gravel pack along completion system 24 deployed in wellbore 22. Initially, the number of zones or sections of the wellbore 22 are determined and the types of swelling fluid to be circulated and displaced into the well (or encountered in the well) for a given operation also may be determined. This determination enables selection of the number of swell packers 30 and the types of swell elements 54 to be utilized. Because each swell packer 30 utilizes a mixture of the swell elements 54, the successful swelling/expansion of the swell packers 30 can be assured even when there are different types of fluids that may be used to cause the desired swelling.

As illustrated, the completion system 24 is initially assembled with the desired components which may include a variety of bottom hole assemblies, alternate path system 28, and the desired number of swellable packers 30, as indicated by block 76. The packers 30 are constructed with the appropriate swellable elements 54 and internal shunt tubes 52. The completion system 24 is then deployed downhole into wellbore 22 via a workstring, as indicated by block 78. Subsequently, a suitable space out procedure may be implemented to help set the completion system 24 at a target depth in the wellbore 22, as indicated by block 80.

Once the completion system 24 is properly positioned, at least one of the appropriate swelling fluids may be pumped or otherwise delivered downhole to, for example, spot swell the desired swellable packers 30, as indicated by block 82. Sufficient time is provided to enable sufficient swelling of the packer elements 54 so as to achieve the desired mechanical barrier and/or pressure isolation function of the subject swellable packers 30. Subsequently, pre-gravel pack preparations may be performed, as indicated by block 84. This allows the gravel pack treatment/installation to be performed to establish the desired gravel pack 38, as indicated by block 86. In some applications, an optional filter cake breaker may be pumped downhole to remove filter cake, as indicated by block 88. At this stage, the workstring may be released and pulled out of hole, as indicated by block 90. The completion system 24 with the shunted swellable packers 30 remains downhole to facilitate subsequent production operations.

Depending on the parameters of a given operation and the environment in which such operation is conducted, the number of swellable packers 30 utilized along the wellbore/borehole 22 may vary substantially. Additionally, the number and arrangement of swellable elements 54 on each packer 30 may vary and may be selected to swell in the presence of a variety of dissimilar fluids. The type of packer frame 44 and the techniques for mounting both the alternate path components as well as the swellable elements 54 about the packer frame 44 may vary. In some embodiments, the swellable elements 54 may be connected or otherwise placed in contact with each other. In other embodiments, however, the swellable elements 54 may be uniquely positioned along each individual swellable packer 30. Similarly, the completion system 24 may have a wide range of configurations and components to help achieve desired gravel packing operations, production operations, and/or other downhole operations.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a completion system sized for deployment in a wellbore, the completion system comprising a production tubing, an alternate path system deployed along the production tubing, and a plurality of swellable packers spaced along the production tubing, each swellable packer of the plurality of swellable packers comprising:

a packer frame disposed about the production tubing and having end rings with openings to receive the alternate path system therethrough;

a plurality of swellable elements positioned longitudinally between the end rings, the plurality of swellable elements comprising a first swellable element consisting of an elastomeric material which swells in the presence of a first fluid and a second swellable element consisting of a different elastomeric material which swells in the presence of a second fluid, the second fluid being a different type of fluid than the first fluid; and wherein the first swellable element and the second swellable element are in contact with each other, and the first swellable element partially overlaps, in a radial direction from the production tubing, the second swellable element.

2. The system as recited in claim 1, wherein the first swellable element swells when in contact with water.

3. The system as recited in claim 2, wherein the second swellable element swells when in contact with oil.

4. The system as recited in claim 1, wherein the plurality of swellable packers comprises at least three swellable packers.

5. The system as recited in claim 1, wherein the alternate path system comprises shunt tubes extending through the first swellable element and the second swellable element.

6. The system as recited in claim 1, wherein each of the first swellable element and the second swellable element is able to independently seal off the wellbore about the swellable packer when swelling occurs due to exposure to the corresponding first fluid or second fluid.

7. A system, comprising:

a packer sized for placement along a well string to enable formation of a seal at a desired location in a borehole, the packer comprising:

a packer frame;

a first swellable element consisting of an elastomeric material mounted to the packer frame;

a second swellable element consisting of a different elastomeric material mounted to the packer frame, the first swellable element and the second swellable element undergoing swelling to form the seal when exposed to a first fluid or a second fluid, respectively, the second fluid being a different type of fluid than the first fluid, the first swellable element and the second swellable element are in contact with each other, and the first swellable element partially overlaps, in a radial direction from a production tubing, the second swellable element; and at least one shunt tube extending through the first swellable element and the second swellable element.

8. The system as recited in claim 7, wherein the first fluid is water and the first swellable element swells in water.

9. The system as recited in claim 8, wherein the second fluid is oil and the second swellable element swells in oil.

10. The system as recited in claim 7, wherein the second fluid is oil and the second swellable element swells in oil.

11. The system as recited in claim 7, wherein the packer is mounted along a downhole completion system having an alternate path system into which the at least one shunt tube is connected.

12. The system as recited in claim 11, further comprising a plurality of additional packers mounted along the downhole completion system, each additional packer comprising a corresponding first swellable element and a corresponding second swellable element.

13. The system as recited in claim 7, wherein the packer frame includes end rings, the first and second swellable elements being secured longitudinally between the end rings.

14. A method, comprising:

constructing a swellable packer with a first swellable element consisting of an elastomeric material and a second swellable element consisting of different elastomer material mounted on a single packer frame, the first swellable element and the second swellable element swelling when exposed to a unique first fluid and a unique second fluid, respectively, the first swellable element and the second swellable element are in contact with each other, and the first swellable element partially overlaps, in a radial direction from a production tubing, the second swellable element;

positioning the swellable packer along a well string;

locating an alternate path system along the well string;

deploying the well string downhole into a wellbore; and forming a seal between the well string and a surrounding wall of the wellbore by exposing the swellable packer to at least one of the unique first fluid or the unique second fluid.

15. The method as recited in claim 14, wherein forming the seal comprises exposing the first swellable element to the unique first fluid in the form of water so as to cause swelling of the first swellable element.

16. The method as recited in claim 14, wherein forming the seal comprises exposing the second swellable element to the unique second fluid in the form of oil so as to cause swelling of the second swellable element.

17. The method as recited in claim 14, wherein positioning comprises positioning a plurality of the swellable packers along the well string.

* * * * *